US005888116A

United States Patent [19]

Espada

[11] Patent Number: 5,888,116

[45] Date of Patent: Mar. 30, 1999

[54] BALLERINA DOLL

[76] Inventor: June C. Espada, P.O. Box 6325, Bronx, N.Y. 10451-6325

[21] Appl. No.: 925,395

[22] Filed: Sep. 8, 1997

[51] Int. Cl.[6] ..... A63H 3/36

[52] U.S. Cl. ..... 446/253; 446/247; 446/236; 446/268

[58] Field of Search ..... 446/268, 391, 446/394, 247, 253, 236; D21/170

[56] References Cited

U.S. PATENT DOCUMENTS

| | | | |
|---|---|---|---|
| D. 83,447 | 2/1931 | Hudson . | |
| D. 126,791 | 4/1941 | Levitt et al. . | |
| D. 148,214 | 12/1947 | Curtis . | |
| D. 171,733 | 3/1954 | Roberts . | |
| 643,426 | 2/1900 | Tamzarian | 446/253 |
| D. 998,526 | 4/1936 | Bitterli . | |
| 1,480,009 | 1/1924 | Preston . | |
| 1,627,511 | 5/1927 | Hopf . | |
| 2,267,094 | 12/1941 | Halsey . | |
| 2,357,871 | 9/1944 | Bolinger . | |
| 2,538,157 | 1/1951 | Lewis . | |
| 3,704,542 | 12/1972 | Suchowski | 446/394 |
| 4,781,647 | 11/1988 | Doane, Jr. . | |
| 5,037,302 | 8/1991 | Sirota . | |
| 5,205,776 | 4/1993 | Lenz | 446/394 |
| 5,257,955 | 11/1993 | Jones | 446/394 |

FOREIGN PATENT DOCUMENTS

| | | | |
|---|---|---|---|
| 59038 | 9/1941 | Denmark | 446/253 |
| 0560351 | 7/1923 | France . | |
| 1506324 | 11/1967 | France | 446/394 |
| 2411618 | 8/1979 | France | 446/294 |

OTHER PUBLICATIONS

Foster Children—soft sculpted dolls, product description/instructions, received in office Aug. 1984, kept in 446/369.

*Primary Examiner*—Robert A. Hafer
*Assistant Examiner*—Jeffrey D. Carlson
*Attorney, Agent, or Firm*—Michael I. Kroll

[57] ABSTRACT

A ballerina doll (10) comprising a torso (12) and a head (14) having a neck (16) integral with the torso (12). A pair of arms (18) are connected to the torso (12). A pair of legs (20) are also connected to the torso (12). A ribbon (22) is provided with a facility (24) for connecting in a permanent manner a middle portion (26) of the ribbon (22) to a crown portion (28) of the head (14). In a first instance the ribbon (22) can be tied into a decorative bow (30). IN a second instance the ribbon (22) when untied can be gripped on it's free ends (32), by a thumb (34) and index finger (36) of a first hand (38) of a person (40), to be carried therefrom. In a third instance the torso (12) can be rotated in a first direction by a second hand (42) of the person (40) to twist the ribbon (22) when gripped by a first hand (38). When the torso (12) is released, the ballerina doll (10) will rotate in an opposite second direction, to simulate twisting and spinning while dancing.

1 Claim, 3 Drawing Sheets

Fig. 3
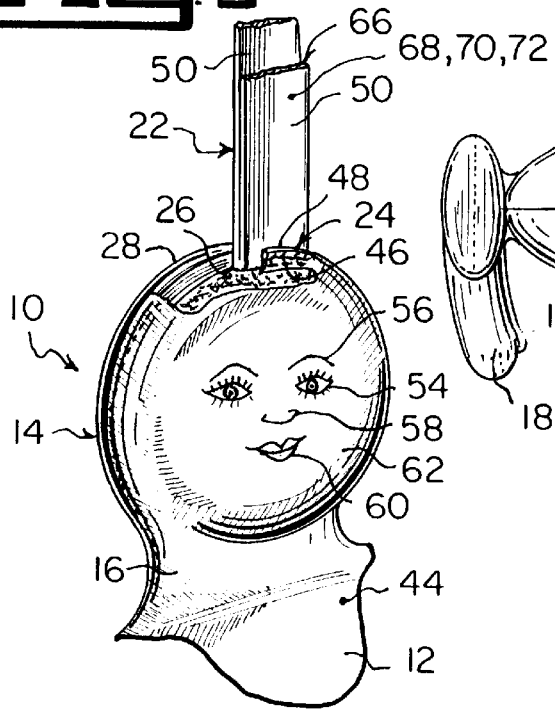
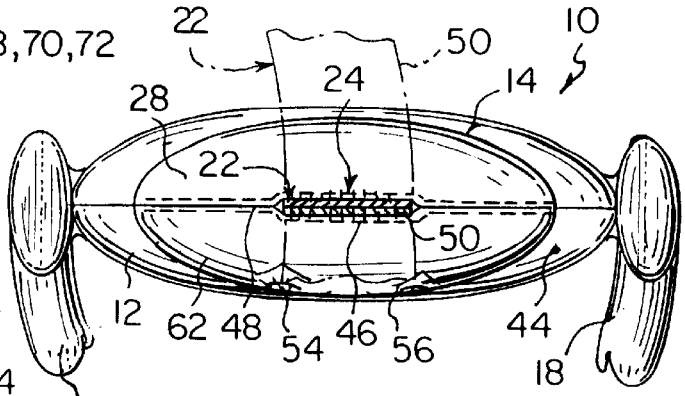
Fig. 4
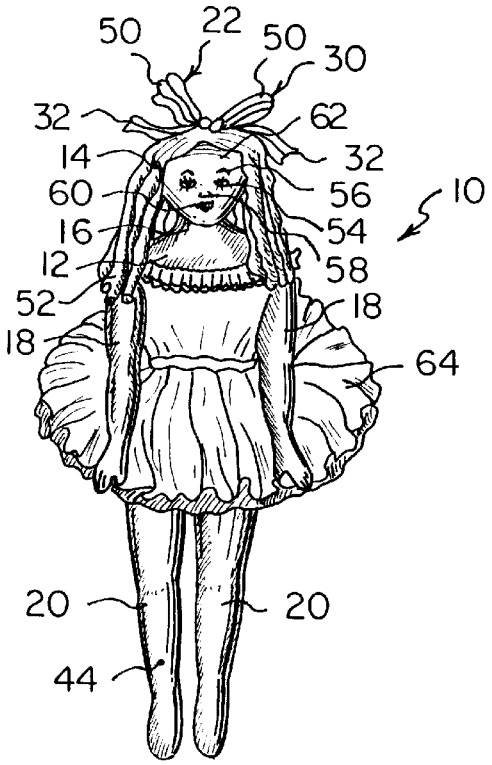
Fig. 5
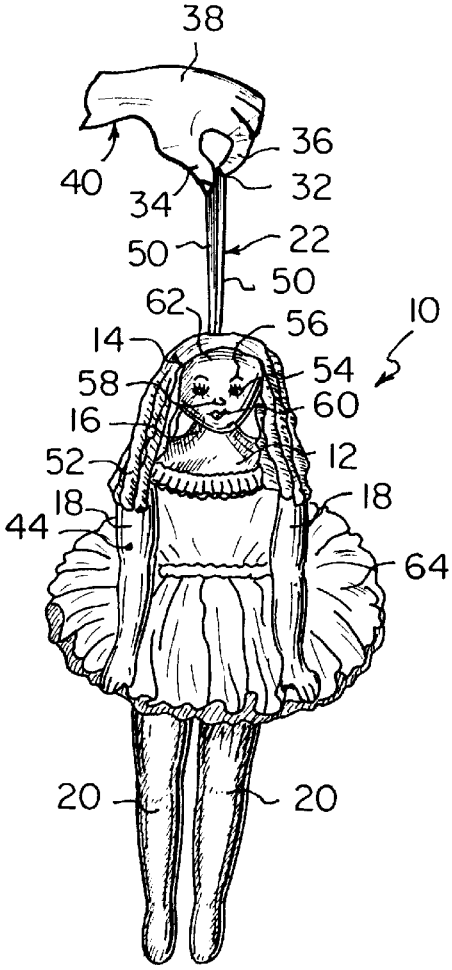
Fig. 6

BALLERINA DOLL

BACKGROUND OF THE INVENTION

1. Field of the Invention

People are familiar with on stage ballerinas performing renditions of Swan Lake, Sleeping Beauty and Shakespearian dramas, etc. One of the most exciting parts of these performances is when the ballerina goes up on tip-toes and does a spin, or when she is tossed up by her dance partner and turns a few times in the air. A dramatic effect can also be created when she is twirled under an extended arm of her dance partner and continues to spin until slowed to a halt.

The ballerina doll was created for precisely this function, to twirl and spin. It is of a simple construction which does not require batteries, a cumbersome windup knob or key. This construction allows a person to play with the ballerina doll using a ribbon connected thereto, with a special twirl feature as many times as you want, without worrying about breaking of damaging the ballerina doll. The ballerina doll is also maintenance free.

The instant invention relates generally to dolls and hair ornaments and more specifically it relates to a ballerina doll. The ballerina doll has a ribbon attached to the top of the head, which can be tied into a bow, be used for carrying and be twisted to cause the doll to twirl about when the doll is released to spin freely.

2. Description of the Prior Art

Numerous dolls and hair ornaments have been provided in prior art. For example, U.S. Pat. No. 1,480,009 to Preston; U.S. Pat. No. 1,627,511 to Hopf; U.S. Pat. No. 2,267,094 to Halsey; U.S. Pat. No. 2,357,871 to Bolinger; U.S. Pat. No. 2,538,157 to Lewis; U.S. Pat. No. 4,781,647 to Doane, Jr.; U.S. Pat. No. 5,037,302 to Sirota and U.S. Pat. No. D83,477 to Hudson all are illustrative of such prior art. While these units may be suitable for the particular purpose to which they address, they would not be as suitable for the purposes of the present invention as heretofore described.

PRESTON, ALSTON L.

BOW HOLDER

U.S. Pat. No. 1,480,009

As an article of manufacture, a bow holder for application to a hair holding support comprising a body of sheet material having two opposite projections for connecting it with the body of the support. Two other opposite projections at an angle to the first two are spaced from the body of the support at their ends.

HOPF, RUDOLFH ALDRIDGE

DOLL HEAD

U.S. Pat. No. 1,627,511

In combination with a doll head having a series of openings therein, of tufts projected through the openings into the interior of the head and secured in the head. The tufts are spaced apart and the head has surface ornamentation representing hair. The tufts represent bunched portions of the hair.

HALSEY, IRIS

DOLL

U.S. Pat. No. 2,267,094

A doll having head and body portions, and clothing thereon made of cloth. Substantially an entire garment thereof is impregnated with a thin, flexible coating of a phosphorescent material.

BOLINGER, GEORGE NOEL

HAIR ORNAMENT

U.S. Pat. No. 2,357,871

A device of the character described comprising a body of relatively soft material having a portion gathered and reduced to relatively small size. A split unitary resilient ring surrounds the gathered portion in gripping engagement therewith. The ring has its ends tapered and spirally overlapping each other to a substantial extent.

LEWIS, MARY LAMB

DOLL

U.S. Pat. No. 2,538,157

A figurine comprising a substantially cylindrical body member, a substantially cylindrical head. A cylindrical neck integrally connects the body member and the head. The body member and head are of the same diameter. Arms have beveled ends pivoted to the body member. Legs have laterally opening recesses therein and opposite side portions of the body member are disposed in the recesses. Pins extending through the leg, the recesses and terminate in the body member. Plates emulating feet are attached to the lower extremities of the legs. Means for simulating eyes, nose and lips are attached to the head. A cord attached to the head simulates hair. Clothing means is associated with the body member, legs and plates. The clothing means includes short pantaloons detachably secured to the body member. A drawstring in the pantaloons is for retaining the same in a fixed position. A skirt is secured to the body member. A bodice is secured to the body member. Means on the legs are for simulating socks. Covers on the plates simulate shoes. The covers have slits therein with strips passed through the slits to form simulated bows.

DOANE, JR., LINWOOD E.

TOY DOLL CONSTRUCTION WITH PHOSPHORESCENT HAIR FIBERS

U.S. Pat. No. 4,781,647

A synthetic phosphorescent fiber having a sectional dimension of less than approximately 0.015 inches and a method of manufacturing the fiber. The fiber comprises a body portion made of a flexible and durable polymeric material which is at least partially translucent and a plurality of phosphorescent particles in the body portion. The particles have a maximum particle size which is less than one half of the sectional dimension of the fibers and between approximately 0.0075 inches and 0.0005 inches and they have a means particle size which is greater than approximately 0.0025 inches. The fibers are manufactured in accordance with the method by mixing appropriately sized phosphorescent particles with a coupling agent, mixing the particles and the coupling agent with a suitable polymer and extruding the resultant mixture to form fibers. The fibers can be effectively utilized for artificial hair for toy dolls as well as for various other applications.

SIROTA, VLADIMIR

EDUCATIONAL TOY WITH A REPAIRABLE DEFECT FOR TEACHING HUMANISTIC VALUES TO A CHILD

U.S. Pat. No. 5,037,302

An educational device for teaching humanistic values to a child is in the form of a toy manufactured with at least one recognizable abused condition or defect. The toy is packaged and marketed with a repair apparatus enabling a child to permanently substantially eliminate the abused condition and effective upon completion of the repair to leave permanent visual reminder of the original abused condition.

HUDSON, GRACE

BOUDOIR DOLL

U.S. Pat. No. Des. 83,447

The figure is a perspective view of a boudoir doll showing the new design. The ornamental design for the boudoir doll is substantially as shown.

SUMMARY OF THE INVENTION

A primary object of the present invention is to provide a ballerina doll that will overcome the shortcomings of the prior art devices.

Another object is to provide a ballerina doll in which a ribbon is affixed to the highest point of the head of the doll, so that the ribbon can be retained and tied into an attractive bow.

An additional object is to provide a ballerina doll in which the ribbon can be gripped at it's free ends to convey the doll, whereby the doll can also be rotated to twist the ribbon and then let go, so that the doll will turn back to simulate twirling and spinning while dancing.

A further object is to provide a ballerina doll that is simple and easy to use.

A still further object is to provide a ballerina doll that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is an enlarged front perspective view of the head portion as indicated by arrow 3 in FIG. 2, with parts broken away and in section.

FIG. 4 is a top cross sectional view taken along line 4—4 in FIG. 2.

FIG. 5 is a front perspective view of the instant invention with the ballerina dress and hair now worn and the ribbon tied into a bow.

FIG. 6 is a front perspective view similar to FIG. 5, with the ribbon untied and it's free ends grasped by the thumb and index finger of a person.

Similar reference characters denote corresponding features consistently throughout the attached drawings.

DETAILED DESCRIPTION OF THE PREFERRED EMBODIMENTS

Figure 1:
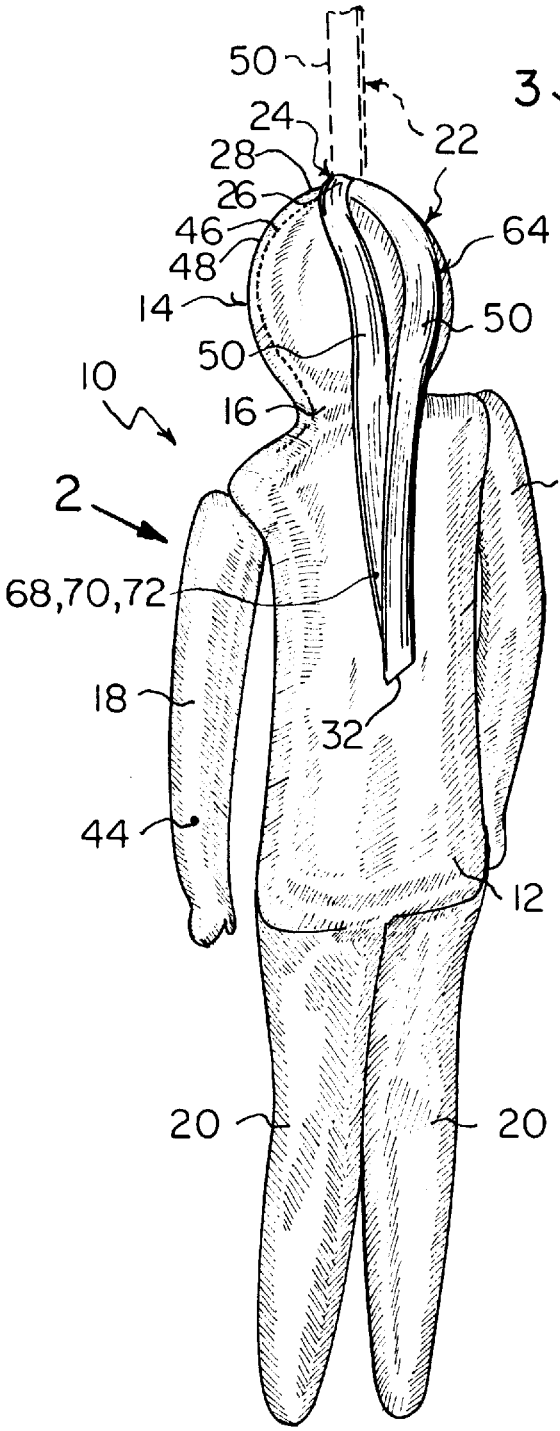
FIG. 1 is a rear perspective view of the instant invention with the ballerina dress and hair removed from the doll and the ribbon untied.
Figure 2:
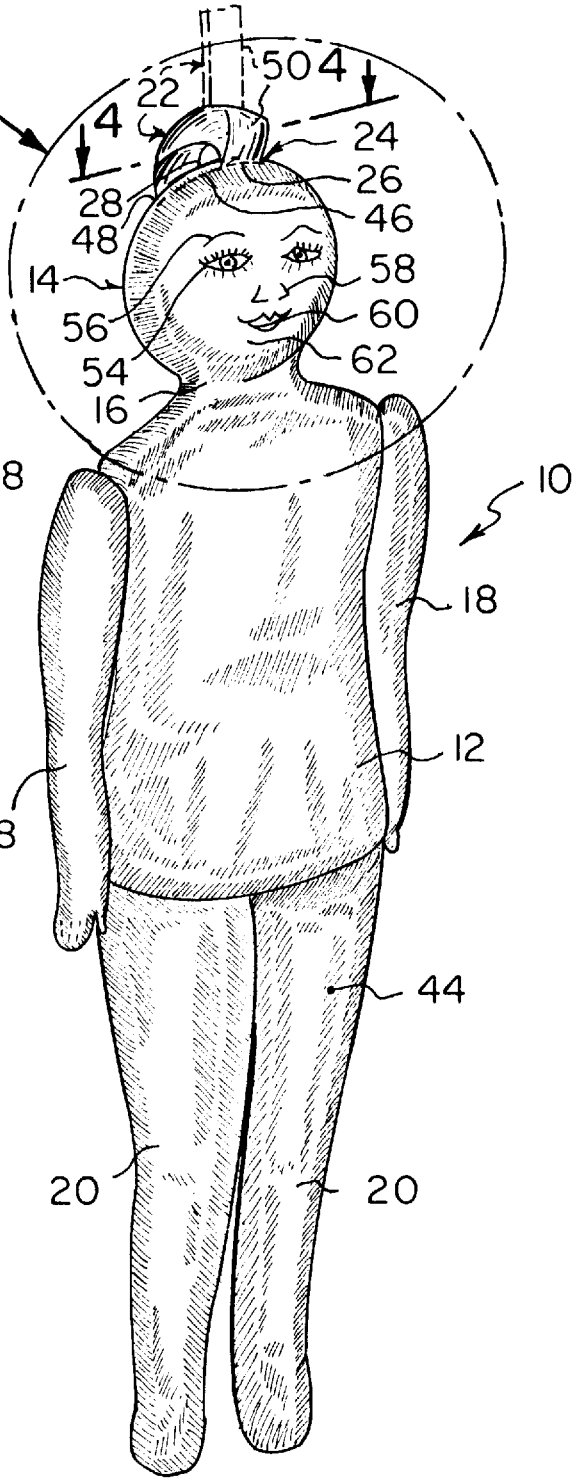
FIG. 2 is a front perspective view taken in the direction of arrow 2 in FIG. 1.

Turning now descriptively to the drawings, in which similar reference characters denote similar elements throughout the several views, FIGS. 1 through 8 illustrate a ballerina doll 10 comprising a torso 12 and a head 14 having a neck 16 integral with the torso 12. A pair of arms 18 are connected to the torso 12. A pair of legs 20 are also connected to the torso 12. A ribbon 22 is provided with a facility 24, for connecting in a permanent manner a middle portion 26 of the ribbon 22 to a crown portion 28 of the head 14.

Figure 7:
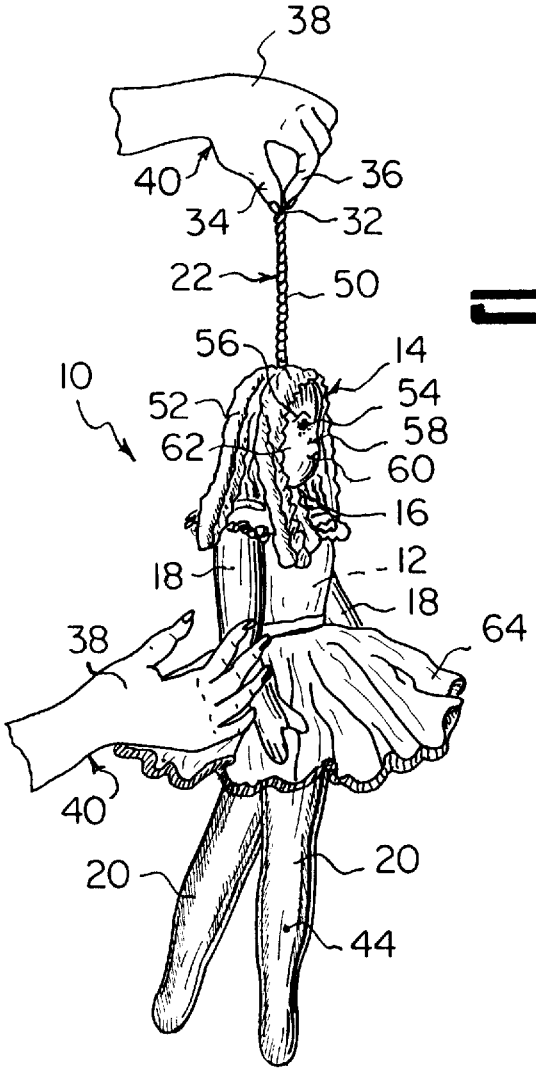
FIG. 7 is a side perspective view similar to FIG. 6, showing the doll being turned and the ribbon being twisted.
Figure 8:
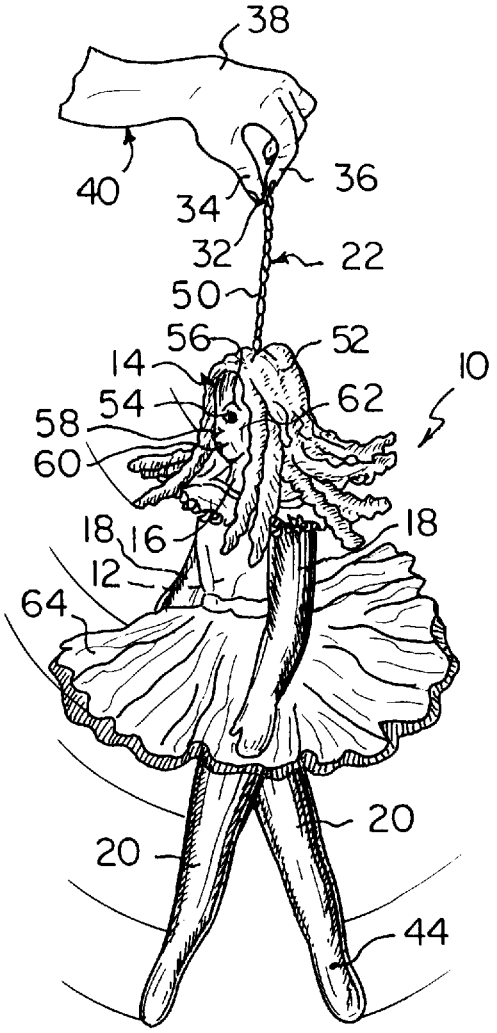
FIG. 8 is a side perspective view similar to FIG. 7, showing the doll released after being turned and is rotating by the twisted ribbon.

In a first instance, as shown in FIG. 5, the ribbon 22 can be tied into a decorative bow 30. In a second instant, as shown in FIG. 6, the ribbon 22 when untied can be gripped on it's free ends 32, by a thumb 34 and index finger 36 of a first hand 38 of a person 40, to be carried therefrom. In a third instance, as shown in FIGS. 7 and 8, the torso 12 can be rotated in a first direction by a second hand 42 of the person 40, to twist the ribbon 22 when gripped by the first hand 38. When the torso 12 is released the ballerina doll 10 will rotate in an opposite second direction to simulate twirling and spinning while dancing.

The torso 12, the head 14 with the neck 16, the arms 18 and the legs 20 are all fabricated out of a soft-sculptured fabric 44. The permanent connecting facility 24 is thread 46, for sewing the middle portion 26 of the ribbon 22 within a seam 48 along the crown portion 28 of the head 14, with the two elongated segments 50 of the ribbon 22 extending therefrom being of equal lengths.

Long synthetic hair 52, as shown in FIGS. 5 to 8, is attached to the crown portion 28 of the head 14, to create a more pleasing feminine appearance thereto. Simulated eyes 54, eyebrows 56, nose 58 and mouth 60 are applied on the head 14, to produce a feminine face 62 thereon. A ballerina cloth dress 64 worn upon the torso 12, simulates an appearance of a female ballet dancer.

The ribbon 22 is fabricated out of a thin flexible material 66. The thin flexible material 66 can be cloth 68. The thin flexible material 66 can be plastic 70. The thin flexible material 66 can also be paper 72.

Since the ballerina doll 10 is soft-sculptured, it can be sewn with different textures of fabrics 44 and trims. The simulated eyes 54, eyebrows 56, nose 58 and mouth 60 on the feminine face 62, can be embroidered or painted on. Different types and colors for the long synthetic hair 52 can be utilized to create a variety of appearances thereto. The ribbon 22 is permanently attached directly to the crown portion 28 of the head 14, as part of the main body of the figure form. No glue is used in the assembly of the ballerina doll 10. The ballerina doll 10 can represent one of an international and multi-cultural set of dolls and all of the basic race groups in the world.

OPERATION OF THE INVENTION

To us the ballerina doll 10, the following steps should be taken:

1. Untie the decorative bow 30 made by the ribbon 22.
2. Hold the extended free ends 32 of the ribbon 22 between the thumb 34 and index finger 36 of the first hand 38.
3. Turn the torso 12 of the ballerina doll 10 with the second hand 42 in a first direction.
4. Make sure that the ballerina doll 10 is in a vertical position.
5. Wind up the ballerina doll 10 until the ribbon 22 is fully twisted.
6. Let the second hand 42 release the ballerina doll 10 to spin and twirl in a second opposite direction.
7. Repeat steps 3 to 6 as many times as you like.

LIST OF REFERENCE NUMBERS

10 ballerina doll
12 torso of 10
14 head of 10
16 neck between 14 and 12
18 arm of 10
20 leg of 10
22 ribbon of 10
24 permanent connecting facility of 10
26 middle portion of 22
28 crown portion of 14
30 decorative bow for 22
32 free end of 22
34 thumb of 38
36 index finger of 38
38 first hand of 40
40 person
42 second hand of 40
44 soft-sculptured fabric for 12, 14, 16, 18 and 20
46 thread of 24
48 seam on 28
50 elongated segment of 22
52 long synthetic hair on 28
54 simulated eye on 14
56 simulated eyebrow on 14
58 simulated nose on 14
60 simulated mouth on 14
62 feminine face on 14

64 ballerina cloth dress on 12
66 thin flexible material for 22
68 cloth for 66
70 plastic for 66
72 paper for 66

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of playing with a doll comprising the steps of:

a) supporting a ballerina doll having a torso, head, arms and legs by holding the untied ends of a ribbon whose middle portion thereof is attached directly to a crown portion of said head, said doll having a ballerina cloth dress mounted on said torso to simulate the appearance of a female ballet dancer;

b) rotating said doll while being held in suspension from said ribbon being held at both ends to wind up said ribbon and allowing the ribbon to unwind for rotating said doll to simulate a twirling ballerina with said dress flaring out;

e) decorating said head by forming said ribbon into a bow; and f) repeating any of the preceding steps.

* * * * *